US008021106B2

(12) United States Patent
Bättig

(10) Patent No.: US 8,021,106 B2
(45) Date of Patent: Sep. 20, 2011

(54) ADJUSTABLE GUIDE DEVICE

(75) Inventor: Josef Bättig, Egliswil (CH)

(73) Assignee: ABB Turbo Systems AG, Baden (CH)

( * ) Notice: Subject to any disclaimer, the term of this patent is extended or adjusted under 35 U.S.C. 154(b) by 881 days.

(21) Appl. No.: 11/656,394

(22) Filed: Jan. 23, 2007

(65) Prior Publication Data

US 2007/0172348 A1 Jul. 26, 2007

(30) Foreign Application Priority Data

Jan. 23, 2006 (EP) ..... 06405029

(51) Int. Cl.
*F01D 17/16* (2006.01)

(52) U.S. Cl. ..... 415/160; 415/163; 415/164; 415/165

(58) Field of Classification Search ..... 415/160, 415/162, 164, 165
See application file for complete search history.

(56) References Cited

U.S. PATENT DOCUMENTS

| | | | | |
|---|---|---|---|---|
| 4,741,666 | A | 5/1988 | Shimizu et al. | |
| 4,925,364 | A * | 5/1990 | Das | 415/150 |
| 5,024,580 | A * | 6/1991 | Olive | 415/150 |
| 5,460,484 | A * | 10/1995 | Yagi | 415/161 |
| 5,498,128 | A * | 3/1996 | Baets et al. | 415/164 |
| 5,518,365 | A * | 5/1996 | Baets et al. | 415/160 |
| 5,993,152 | A * | 11/1999 | Schilling | 415/160 |
| 6,312,217 | B1 | 11/2001 | Takahashi | |
| 6,527,508 | B2 * | 3/2003 | Groskreutz et al. | 415/164 |
| 6,659,718 | B2 * | 12/2003 | Jinnai et al. | 415/164 |
| 6,736,595 | B2 * | 5/2004 | Jinnai et al. | 415/164 |
| 6,763,587 | B2 * | 7/2004 | Jinnai et al. | 29/889.2 |
| 6,984,104 | B2 * | 1/2006 | Alexander et al. | 415/159 |
| 7,112,041 | B2 * | 9/2006 | Debeneix et al. | 415/162 |
| 7,351,042 | B2 * | 4/2008 | Jinnai et al. | 417/407 |
| 7,396,204 | B2 * | 7/2008 | Shiraishi et al. | 415/160 |
| 2004/0115045 | A1 * | 6/2004 | Alexander et al. | 415/165 |
| 2004/0261413 | A1 | 12/2004 | Nishiyama et al. | |
| 2005/0011192 | A1 * | 1/2005 | Ohishi | 60/602 |

FOREIGN PATENT DOCUMENTS

| | | |
|---|---|---|
| DE | 103 13 167 A1 | 10/2004 |
| EP | 1 234 951 A2 | 8/2002 |
| EP | 1 396 621 A1 | 3/2004 |
| EP | 1 520 959 A1 | 4/2005 |

* cited by examiner

*Primary Examiner* — Edward Look
*Assistant Examiner* — Sean J Younger
(74) *Attorney, Agent, or Firm* — Buchanan Ingersoll & Rooney PC

(57) ABSTRACT

A guide device with adjustable guide vanes is provided with a drive for the adjustable guide vanes, in which a cylindrical driving pin and an adjusting lever are provided each with one surface pair which are matched to one another and which slide on one another in operation when the guide vanes are being adjusted. To adjust the guide vanes, the adjusting ring is moved, by which the driving pin attached to the adjusting ring slides in an elongated groove of the adjusting lever and applies a force to the adjusting lever. This approach yields an economical and durable structure which is easy to install. This results in surface support with the corresponding low compressive loads per unit area and consequently greatly reduced wear.

16 Claims, 6 Drawing Sheets

ADJUSTABLE GUIDE DEVICE

CROSS REFERENCE TO RELATED APPLICATIONS

This application claims priority under 35 U.S.C. §119 to EP Application 06405029.7 filed in European Patent Office on 23 Jan. 2006, the entire contents of which are hereby incorporated by reference in their entireties.

FIELD

The disclosure relates to the field of hydrodynamic machines pressurized with exhaust gases of internal combustion engines. For example, a device is disclosed for transmitting an adjustment force from an adjusting ring to the vane shaft of a pivotally mounted guide vane of an adjustable guide device of the exhaust gas turbine or of the compressor of an exhaust gas turbocharger, a guide device with this transmission device, a compressor and an exhaust gas turbine with such a guide device and an exhaust gas turbocharger with such a compressor and/or with such an exhaust gas turbine.

BACKGROUND INFORMATION

Exhaust gas turbochargers are used to boost the output of internal combustion engines. In modern internal combustion engines, matching the exhaust gas turbocharger to variable operating conditions is becoming increasingly more difficult. So-called variable turbine and/or compressor geometry offers one popular possibility. In a variable turbine geometry the guide vanes of the guide apparatus are aligned more or less steeply to the flow upstream of the turbine wheel according to the turbine power demand. In variable compressor geometry the diffusor vanes are aligned more or less steeply to the flow downstream from the compressor wheel. The vanes are generally adjusted via so-called adjusting levers which are moved by an adjusting ring located concentrically to the axis of the exhaust gas turbocharger. For radial turbines or radial compressors the guide vane or diffusor vane is generally parallel to the shaft axis. The shaft of the guide vane or diffusor vane is preferably supported twice in a housing and is turned by means of an adjusting lever which acts on the vane shaft between the two bearing points. If the adjusting lever is to be moved directly by means of recesses in the adjusting ring, its end, as described for example in EP 1 520 959, must be made cylindrical so that it does not stick in the groove.

Even if the adjusting ring is provided with lifters which engage the corresponding grooves of the adjusting lever, these lifters must be made cylindrical, for example as inserted driving pins, as shown by EP 1 234 951.

To adjust the guide vanes the adjusting ring is turned concentrically around the turbocharger axis, by which the guide vanes are pivoted by means of the adjusting levers.

Due to this rotary and pivoting motion, the cylinder of the adjusting lever or of the grooved ring is moved on the groove surface of the grooved ring or of the adjusting lever. Due to the linear support of the cylinder in the grooves of the adjusting lever or grooved ring, very high Hertzian compressive loads arise in spite of moderate normal forces. The sliding partners wear in operation due to the relative movements of the cylinder on the groove surface and the high compressive loads per unit area U.S. Pat. No. 4,741,666 discloses a device for transmitting an adjustment force from an adjusting ring to the vane shaft of a pivotally mounted guide vane, with an adjusting lever and a driving sleeve which can be connected to an adjusting ring and which is pivotally mounted on a pin. The driving sleeve and a groove of the adjusting lever each have contact surfaces which are matched in pairs to one another.

Comparable devices are disclosed in EP 1 396 621 and U.S. Pat. No. 6,312,217.

SUMMARY

An exemplary guide device with adjustable guide vanes is disclosed, which operates reliably over a long operating time and which can moreover be easily mounted/dismounted.

An exemplary guide device with adjustable guide vanes is provided with a drive for the adjustable guide vanes, in which a cylindrically made driving pin and an adjusting lever are provided each with one surface pair which are matched to one another and which slide on one another in operation when the guide vanes are being adjusted. The driving pins are provided for this purpose with a recess in the jacket surface. To adjust the guide vanes, the adjusting ring is moved, by which the driving pin attached to the adjusting ring slides along in an elongated groove of the adjusting lever and applies a force to the adjusting lever.

This approach yields an economical and durable structure. The cylindrical driving pin is on the one hand supported on either side in the adjusting ring and is moreover fixed axially positively in the groove of the adjusting lever. This results in surface support with the corresponding low compressive loads per unit area and consequently greatly reduced wear. The adjusting ring can be located both radially inside and also outside of the guide vanes.

The driving pin can be easily produced very economically and is moreover captively connected to the adjusting ring or to the adjusting lever after installation. The recesses in the jacket surface enable the driving pin to be pushed axially through the bearing holes and enable subsequent axial fixing by means of the adjusting lever. In this way an additional component for axial locking is unnecessary.

In one exemplary embodiment the adjusting ring has a U-shaped cross section with a groove and a number of holes corresponding to the number of guide vanes for holding the driving pin.

The adjusting levers are arranged radially and on their end advantageously have circular segments which are arranged concentrically to the vane shaft, which correspond to the groove base of the adjusting ring and thus provide for its radial support.

BRIEF DESCRIPTION OF THE DRAWINGS

Various embodiments of the invention are detailed below using the drawings.

DETAILED DESCRIPTION

Figure 1:
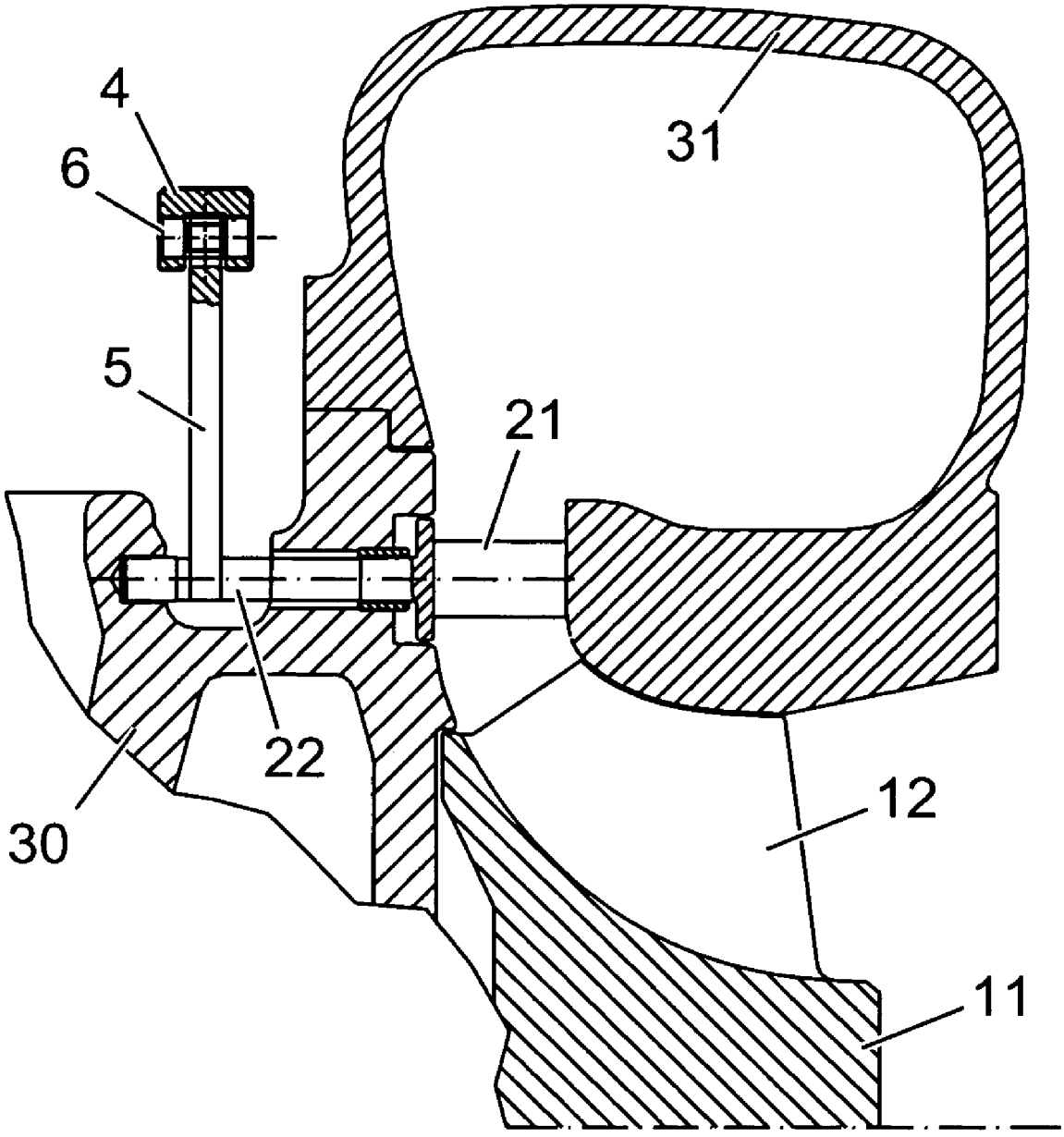
FIG. 1 shows a section routed along the axis through a radial turbine with an exemplary adjustable guide device.
Figure 2:
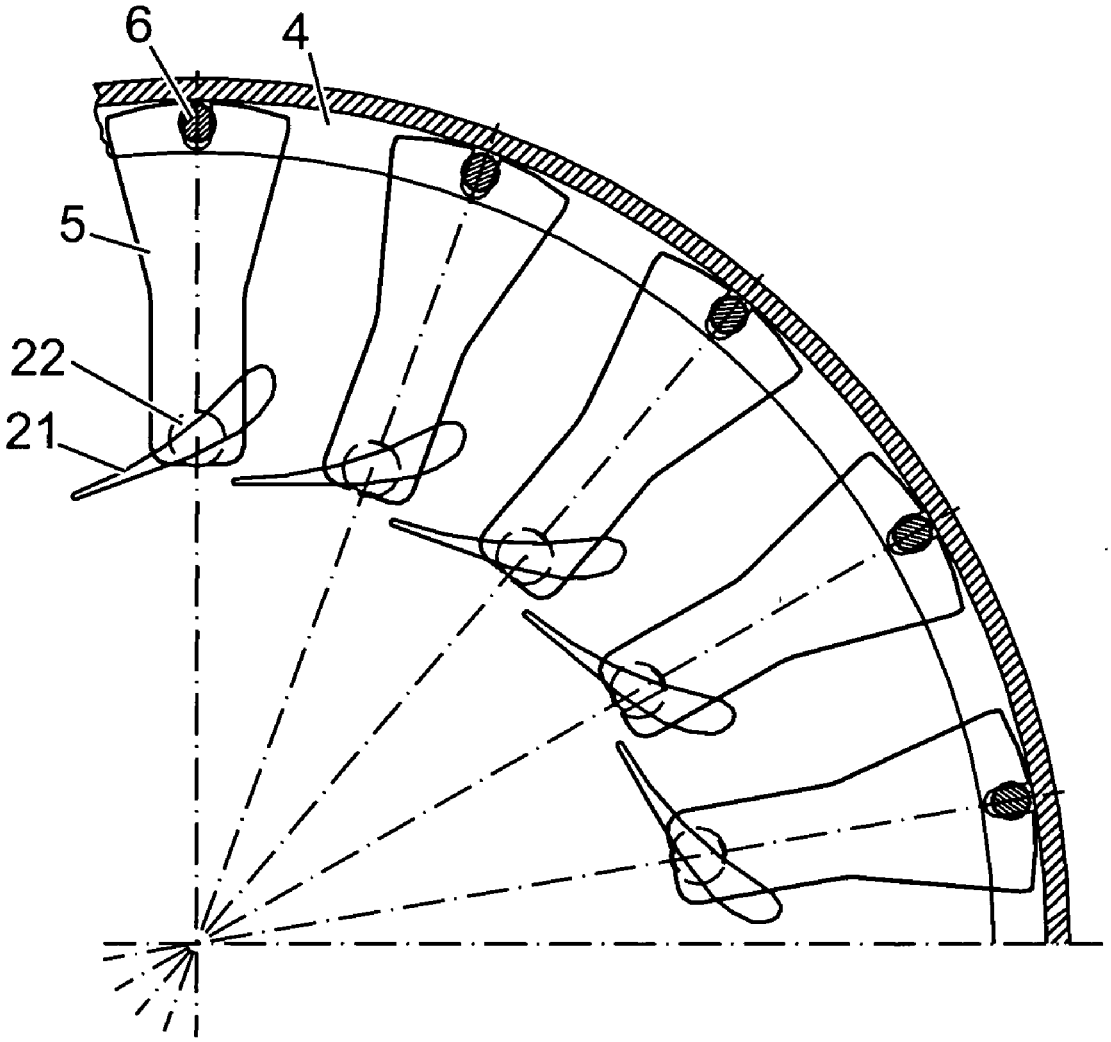
FIG. 2 shows a section perpendicular to the axis through the adjustable guide device of the radial turbine as shown in FIG. 1.

FIGS. 1 and 2 show an exemplary exhaust gas turbine as is used for example in exhaust gas turbochargers, with an adjustable guide device.

The illustrated radial turbine comprises a turbine wheel which is located on a shaft which is pivotally mounted in the bearing housing 30. The turbine wheel has a hub 11 with a host of a rotor blades 12. The turbine wheel hub together with the turbine housing 31 borders a flow channel. In the flow direction upstream from the turbine wheel the flow channel is bordered by the bearing housing 30 and the turbine housing 31. In this region there is an adjustable guide device.

The guide device comprises several adjustable guide vanes 21 which can each be rotated around a pivotally mounted vane shaft 22. The guide vane and the vane shaft can be connected to one another by a force-fit, form-fit or materially.

The vane shaft 22 is pivotally mounted in the bearing housing 30. To drive the vane shaft there is an adjusting lever 5 which is connected to the vane shaft and which transmits force to the vane shaft from an adjusting ring 4 which is located radially outside the vane shaft relative to the turbine axis. The adjusting lever is connected by a force-fit, form-fit or materially to the vane shaft.

Figure 3:
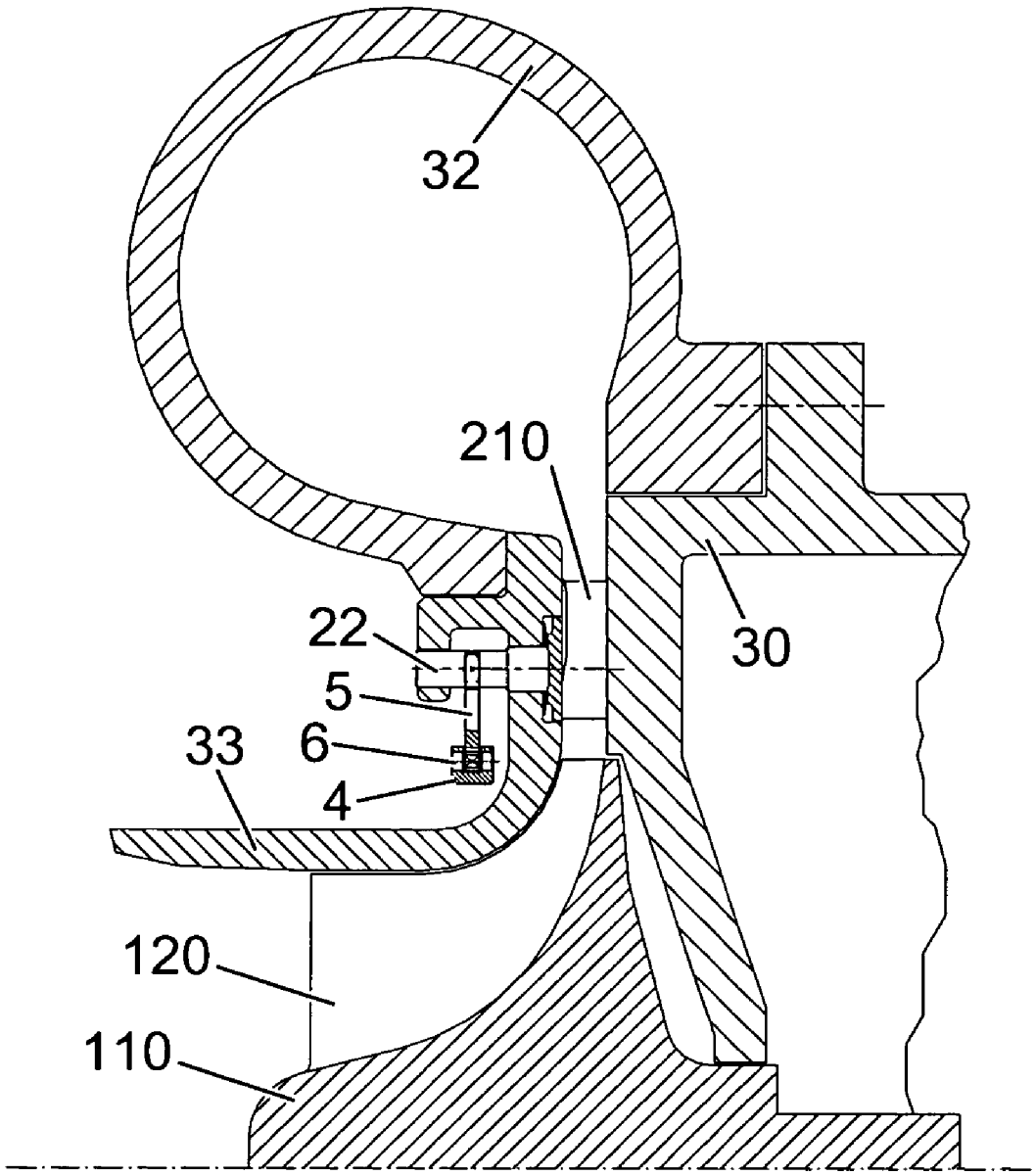
FIG. 3 shows a section routed along the axis through a radial compressor with an exemplary adjustable guide device.
Figure 4:
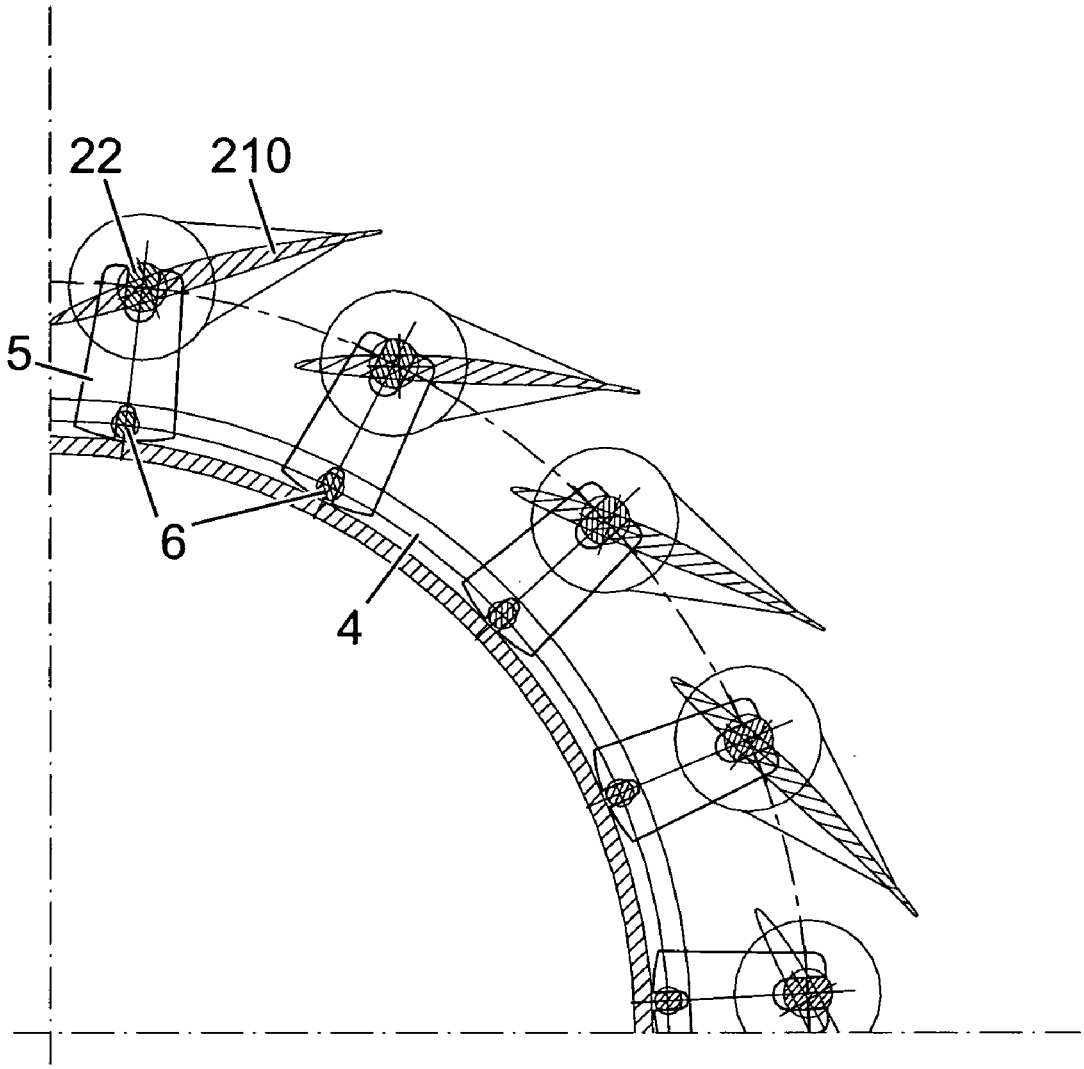
FIG. 4 shows a section perpendicular to the axis through the adjustable guide device of the radial compressor as shown in FIG. 3.

FIGS. 3 and 4 show an exemplary compressor as is used for example in exhaust gas turbochargers, with an exemplary guide device.

The illustrated exemplary embodiment of a radial compressor comprises a compressor wheel which is located on a shaft which is pivotally mounted in the bearing housing 30. The compressor wheel has a hub 110 with a host of a rotor blades 120. The compressor wheel hub together with an insert wall 33 borders a flow channel. In the flow direction downstream from the compressor wheel the flow channel is bordered by the bearing housing and the compressor exit housing 32. In the region of the diffusor, downstream from the compressor wheel, there is an adjustable diffusor guide device.

This guide device comprises a plurality of adjustable guide vanes 210 which can each be rotated around a pivotally mounted vane shaft 22. The guide vane and the vane shaft can be connected to one another by a force-fit, form-fit or materially.

The vane shaft is pivotally mounted in the housing. To drive the vane shaft there is an adjusting lever 5 which transmits force to the vane shaft from an adjusting ring 4 which is located radially inside the vane shaft relative to the compressor axis. The adjusting lever is connected by a force-fit, form-fit or materially to the vane shaft.

Figure 5:
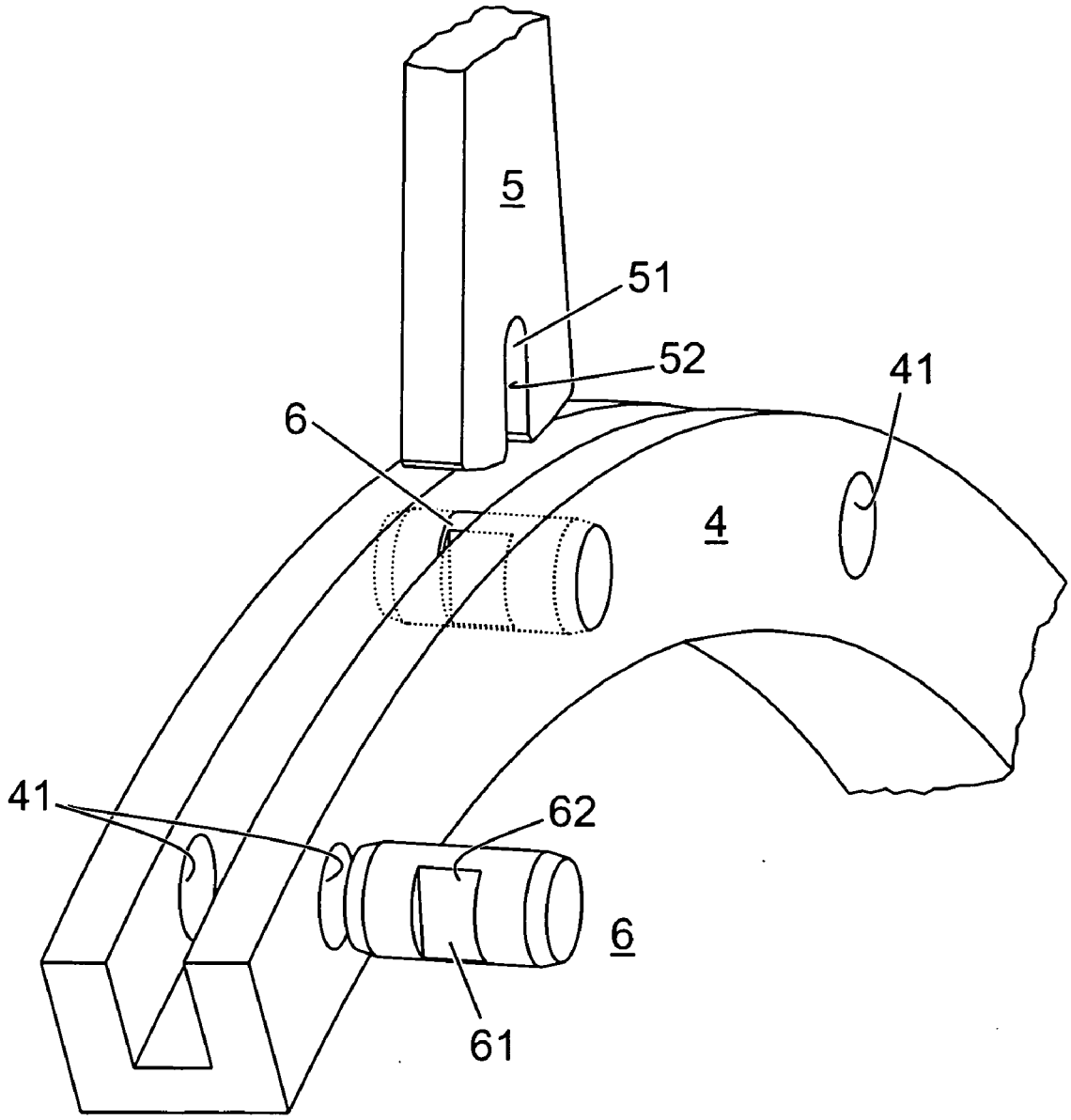
FIG. 5 shows an isometric detail of an exemplary guide device with an adjusting lever and a driving pin.

In both exemplary embodiments, with the adjusting lever inside or outside, an elongated groove 51 is inlet into the free end of the adjusting lever 5, as is shown in FIG. 5. In the elongated groove a driving pin 6 is held which moves with the adjusting ring on the segment of a circular arc which runs concentrically to the shaft axis. The elongated groove can also be made as a slot in which the driving pin can move back and forth, but which prevents the driving pin from being pulled entirely out of the groove The driving pin 6 and the elongated groove 51 each have two parallel contact surfaces. The two contact surfaces 62 of the cylindrically made driving pin 6 are shaped by opposing recesses 61 which have been inlet into the jacket surfaces and which are arranged parallel to one another. The two contact surfaces 52 of the elongated groove in the adjusting lever 5 are likewise arranged parallel to one another. The distances of the two contact surface pairs are chosen such that the driving pin in the region of the two recesses 61 can be inserted into the groove 51 of the adjusting lever and is in contact on both sides with the surfaces of the groove. On the one hand, the driving pin with the two contact surfaces 62 should slide without friction as much as possible along the contact surfaces 52 of the groove. On the other hand, the driving pin should not be able to move perpendicular to the contact surfaces with respect to the adjusting lever so that the adjusting lever does not vibrate in operation around the driving pin.

The driving pin is supported once or twice in the adjusting ring 4. In the illustrated double support the adjusting ring is made U-shaped and the adjusting lever runs in the middle of the U-shaped profile. The driving pin has a center, double-sided recess via which the adjusting ring can be moved. The driving pin is locked in the axial direction by the side walls of the two recesses 61 adjoining the adjusting lever 5 flush. This facilitates installation of the adjusting device. The driving pins are inserted axially into the holes 41 in the adjusting ring 4, as shown in FIG. 5 at the bottom, and then the adjusting levers 5 are pushed into the double-sided recesses in the radial direction from the standpoint of the driving pin. No other axial locking of the driving pin is necessary.

Figure 6:
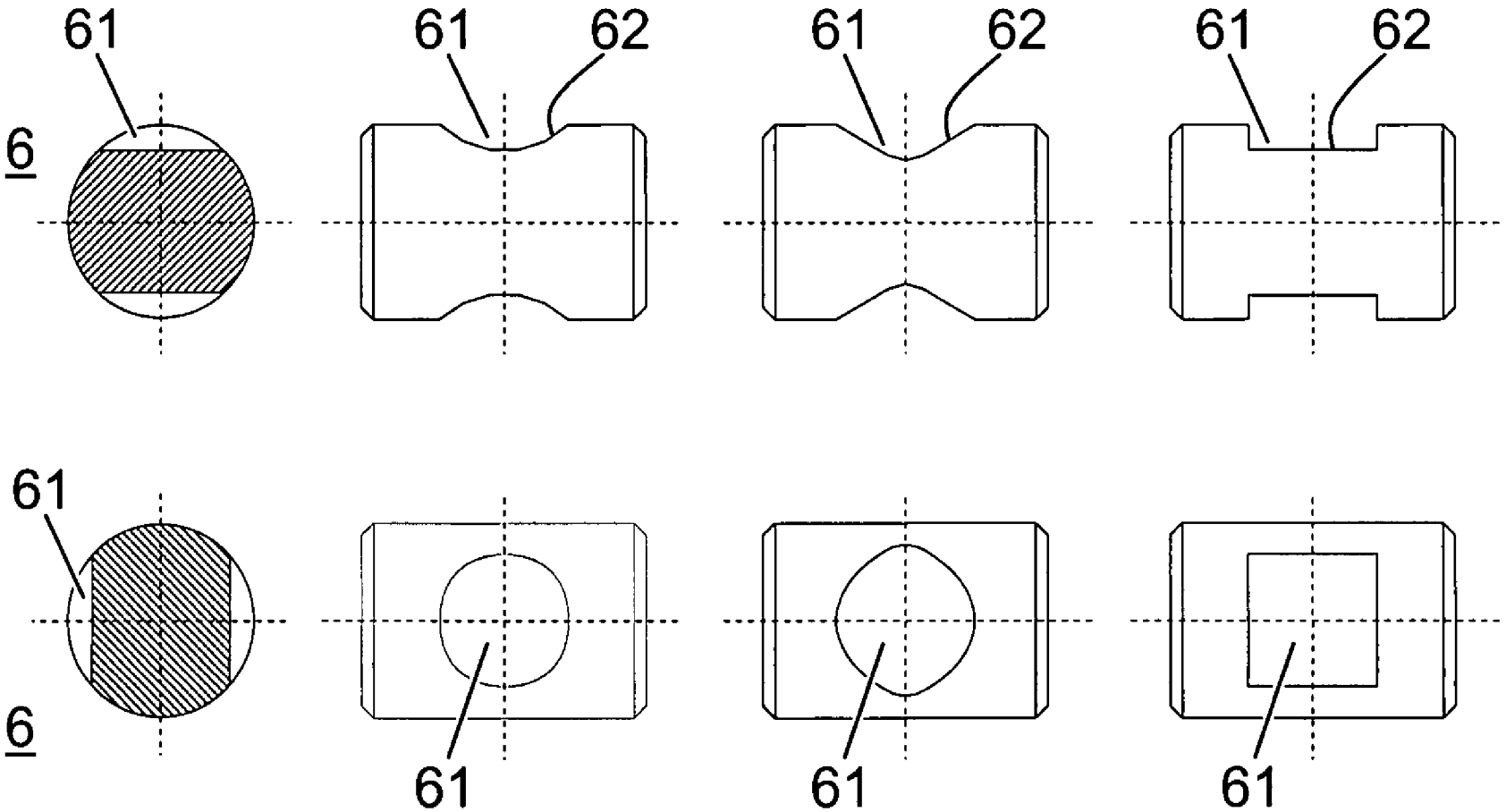
FIG. 6 shows three different exemplary embodiments of the driving pin as shown in FIG. 5.

As shown in FIG. 6, the recesses 61 in the exemplary driving pins can be made differently. From left to right three driving pins are shown, with two rounded recesses each (left), two V-shaped recesses which run to a point (middle), and two rectangular recesses (right). A driving pin can also have two differently made recesses, for example on one side a rectangular one, and a rounded one on the other side. In this way the alignment of the driving pin can be defined with respect to the adjusting lever. The surfaces of the groove of the adjusting lever are shaped according to the respective recesses of the driving pins. Instead of one or two recesses, the driving pin can also have one or two projections which interact with the correspondingly made recesses in the side walls of the elongated groove of the adjusting lever.

To improve the sliding property of the driving pin in the groove of the adjusting ring, the contact surfaces of the driving pin and/or of the adjusting lever can be specially hardened or coated with a sliding aid.

The exemplary embodiments of guide devices as variously disclosed can be used both in the compressor and/or turbine of an exhaust gas turbocharger for supercharging of two-stroke and four-stroke internal combustion engines and also in turbines for useful turbines operated with the exhaust gases of an internal combustion engine.

REFERENCE NUMBER LIST

| | |
|---|---|
| 11 | turbine wheel hub |
| 110 | compressor wheel hub |
| 12 | turbine rotor blades |
| 120 | compressor rotor blades |
| 21 | guide vane |
| 210 | diffusor vane |
| 22 | vane shaft |
| 30 | bearing housing |
| 31 | turbine housing |
| 32 | compressor housing |
| 33 | insert wall |
| 4 | adjusting ring |
| 41 | holes |
| 5 | adjusting lever |
| 51 | groove |
| 52 | contact surface |
| 6 | driving pin |
| 61 | recess |
| 62 | contact surface |

The invention claimed is:

1. A device for transmitting an adjustment force from an adjusting ring to a vane shaft of a pivotally mounted guide vane of an adjustable guide device, comprising:

a driving pin having a cylindrical jacket surface including first and second planar contact surfaces formed by opposing recesses inlet into the cylindrical jacket surface of the driving pin, the driving pin connectable to the adjusting ring; and an adjusting lever including one end connectable to the vane shaft of the pivotally mounted guide vane of the adjustable guide device, and an other end including an elongated groove having third and fourth contact surfaces matched to the first and second contact surfaces of the driving pin, the elongated groove for holding the driving pin which is inlet into the other end of the adjusting lever.

2. Device as claimed in claim 1, wherein the recesses in the surface of the driving pin have a rectangular or a rounded or a V-shaped profile.

3. Device as claimed in claim 1, wherein the two recesses of the surface of the driving pin have different profiles.

4. Device as claimed in claim 1, wherein the contact surfaces of the groove and/or the contact surfaces of the driving pin are hardened or coated with a sliding aid.

5. A guide device comprising:

a pivotally mounted vane shaft;

adjustable guide vanes, which guide vanes are each connected to the pivotally mounted vane shaft;

adjusting levers, each adjustable guide vane being pivotable around the vane shaft via the adjusting lever;

an adjusting ring for driving the adjusting levers, the adjusting ring acting on the vane shaft, and being connected to the vane shaft, the adjusting ring having a first groove formed therein, with the adjusting levers fitted into said first groove;

a driving pin connectable to a respective adjusting lever and which is pivotally mounted in the adjusting ring per the respective adjusting lever; the respective adjusting lever being connected on one end to the vane shaft of a guide vane, and including an elongated second groove for holding the respective driving pin being inlet into an other end of the adjusting lever, the driving pin having a cylindrical jacket surface with first and second planar contact surfaces and the second groove having respective third and fourth contact surfaces, the first and second contact surfaces of the driving pin and the respective third and fourth contact surfaces of the adjusting lever each being matched to abut one another, and the contact surfaces in the driving pin being formed by poopsing recesses inlet into the cylindrical, jacket surface of the driving pin.

6. Guide device, comprising:

adjustable guide vanes with a pivotally mounted vane shaft;

an adjusting lever acting on the vane shaft per guide vane;

an adjusting ring for driving the adjusting lever; and a driving pin connectable to a respective adjusting lever and which is pivotally mounted in the adjusting ring per the adjusting lever; the adjusting lever being connected on one end to the vane shaft of a guide vane, and including an elongated groove for holding the respective driving pin being inlet into an other end of the adjusting lever, the driving pin having a cylindrical jacket surface with first and second planar contact surfaces and the groove having respective third and fourth contact surfaces, the first and second contact surfaces of the driving pin and the respective third and fourth contact surfaces of the groove each being matched to abut one another, and the contact surfaces in the driving pin being formed by opposing recesses inlet into the cylindrical jacket surface of the driving pin.

7. Guide device as claimed in claim 6, wherein the driving pin is pivotally mounted in holes of the adjusting ring.

8. Compressor with a diffusor with adjustable diffusor vanes, wherein the diffusor comprises a guide device as claimed in claim 6.

9. Exhaust gas turbine, comprising a guide device as claimed in claim 6.

10. Exhaust gas turbocharger, comprising a compressor as claimed in claim 8.

11. Exhaust gas turbocharger, comprising an exhaust gas turbine as claimed in claim 9.

12. Exhaust gas turbocharger, comprising a compressor with a diffusor having adjustable diffusor vanes and an exhaust gas turbine as claimed in claim 9.

13. The device as claimed in claim 2, wherein at least one of the contact surfaces of the groove and the contact surfaces of the driving pin are hardened or coated with a sliding aid.

14. Device as claimed in claim 3, wherein at least one of the contact surfaces of the groove and the contact surfaces of the driving pin are hardened or coated with a sliding aid.

15. The compressor with a diffusor with adjustable diffusor vanes, wherein the diffusor comprises a guide device as claimed in claim 7.

16. An exhaust gas turbine, comprising a guide device as claimed in claim 7.

* * * * *